US008056744B2

(12) United States Patent
Ekkert

(10) Patent No.: US 8,056,744 B2
(45) Date of Patent: Nov. 15, 2011

(54) CLOSURE WITH RING RIBS

(75) Inventor: Len Ekkert, Naperville, IL (US)

(73) Assignee: Phoenix Closures, Inc., Naperville, IL (US)

( * ) Notice: Subject to any disclaimer, the term of this patent is extended or adjusted under 35 U.S.C. 154(b) by 925 days.

(21) Appl. No.: 11/652,789

(22) Filed: Jan. 12, 2007

(65) Prior Publication Data

US 2008/0169262 A1 Jul. 17, 2008

(51) Int. Cl.
*B65D 41/04* (2006.01)
*B65D 53/00* (2006.01)

(52) U.S. Cl. ..... 215/344; 215/44; 215/353

(58) Field of Classification Search ..... 215/344, 215/353, 341, 44, 45, 343
See application file for complete search history.

(56) References Cited

U.S. PATENT DOCUMENTS

| | | | | |
|---|---|---|---|---|
| 3,463,340 | A | 8/1969 | Lindstrom | |
| 3,844,439 | A | 10/1974 | Demers et al. | |
| 4,143,785 | A | 3/1979 | Ferrell | |
| 4,276,989 | A | 7/1981 | Hicks | |
| 4,531,649 | A | 7/1985 | Shull | |
| 4,560,077 | A | 12/1985 | Dutt | |
| 4,561,553 | A | 12/1985 | Crisci | |
| 4,566,603 | A | 1/1986 | Moore | |
| 4,609,115 | A | 9/1986 | Moore et al. | |
| 4,637,519 | A | 1/1987 | Dutt et al. | |
| 4,844,268 | A | 7/1989 | Bullock, III | |
| 4,913,299 | A | 4/1990 | Petro | |
| 5,213,224 | A | 5/1993 | Luch | |
| 5,292,020 | A | 3/1994 | Narin | |
| 5,449,078 | A | 9/1995 | Akers | |
| 5,489,036 | A | 2/1996 | Arkins | |
| 5,553,727 | A | 9/1996 | Molinaro | |
| 5,560,504 | A | 10/1996 | Molinaro | |
| 5,887,738 | A | 3/1999 | Bietzer et al. | |
| 5,927,532 | A | 7/1999 | Traub | |
| 5,971,183 | A | 10/1999 | Bartsch | |
| 6,003,701 | A | 12/1999 | Hidding et al. | |
| 6,044,994 | A | 4/2000 | Miller | |
| 6,082,569 | A | 7/2000 | Druitt | |
| 6,164,503 | A | 12/2000 | Forsyth et al. | |
| 6,257,432 | B1 | 7/2001 | Ekkert | |
| 6,848,590 | B2 | 2/2005 | Brozell et al. | |
| 6,874,648 | B2 | 4/2005 | Willingham et al. | |
| 2003/0155323 | A1 * | 8/2003 | Ekkert | 215/344 |
| 2004/0188375 | A1 * | 9/2004 | Camacho-Paredes | 215/344 |
| 2005/0103742 | A1 | 5/2005 | Pairis | |
| 2006/0108316 | A1 * | 5/2006 | King | 215/344 |

* cited by examiner

*Primary Examiner* — Anthony Stashick
*Assistant Examiner* — Niki Eloshway
(74) *Attorney, Agent, or Firm* — Husch Blackwell LLP

(57) ABSTRACT

A closure and container combination where the closure has flanges that define a channel capable of receiving a portion of the neck of a container and forming a surface seal therewith.

13 Claims, 4 Drawing Sheets

CLOSURE WITH RING RIBS

FIELD OF THE INVENTION

This invention relates to a closure and container combination forming a surface seal.

BACKGROUND OF THE INVENTION

Many different kinds of packaged products, such as food, beverages and pharmaceuticals, can be adversely impacted through exposure to oxygen. The presence of oxygen in a package can cause oxygen contamination of the product being stored therein. The reaction of oxygen with chemicals present in foods and beverages can impact their odor and flavor. The reaction of oxygen with pharmaceuticals can impact their efficacy.

Molecular oxygen ($O_2$) can react with a number of different compounds that are found in a number of foods and beverages. Molecular oxygen can be reduced by other molecules through the addition of electrons to form, e.g., a superoxide, a hydroxyl radical, or hydrogen peroxide. Each of these reduced forms of oxygen is very reactive and is thus likely to react with a number of products in the food and beverage industry. The reduced forms of oxygen are especially likely to react with the carbon-carbon double bonds found in almost all products with complex organic components. This reaction can cause the rapid degradation of the product. For example, the oxidated product may have an altered odor or flavor.

During storage of containers, particularly after any initial seal has been ruptured by a first opening of a container, often air, including oxygen, can leak and migrate into an ostensibly closed container through gaps between the container and the closure. This influx of oxygen and other airborne contaminants can be detrimental to the materials stored in the container. For this and other reasons, it is preferable to have a container and closure combination that forms a good seal.

SUMMARY OF THE INVENTION

Accordingly, a container and closure combination is provided. The container preferably has a neck with a base portion and a flexible upper portion. The upper portion has a proximal segment that is oriented in a first inward angle relative to the base portion and a distal segment that is oriented in a second inward angle relative the base portion.

The closure preferably has a generally planar top portion, an outer peripheral edge portion, and an annular skirt depending from the peripheral edge portion. Preferably, the top portion has at least one inner flange and at least one outer flange depending therefrom. The outer flange can be relatively flexible with an angled inner surface. The angled inner surface can correspond to the first inward angle of the proximal segment such that the inner surface of the outer flange is generally 0.0 to 6.0 degrees offset from that surface. Preferable, the inner surface of the outer flange is generally 1.0 to 3.0 degrees offset. The inner flange can be relatively rigid and have an outer angled surface.

Preferably, the angled inner surface of the outer flange and the outer angled surface of the inner flange define a channel that is capable of receiving a part of the upper portion of the neck of the container. When received, the inner flange biases the part of the upper portion of neck that is in the channel against the outer flange, specifically against the inner surface of the outer flange. Preferably, the part of the upper portion is engaged in such a manner that at least part of an upper surface of the proximal segment of the neck and at least part of the inner surface of the outer flange form a surface seal.

While the present invention is susceptible of embodiments in various forms, there will hereinafter be described some exemplary and non-limiting embodiments, with the understanding that the present disclosure is to be considered an exemplification of the invention and is not intended to limit the invention to the specific embodiments illustrated.

DETAILED DESCRIPTION OF THE INVENTION

Figure 1:
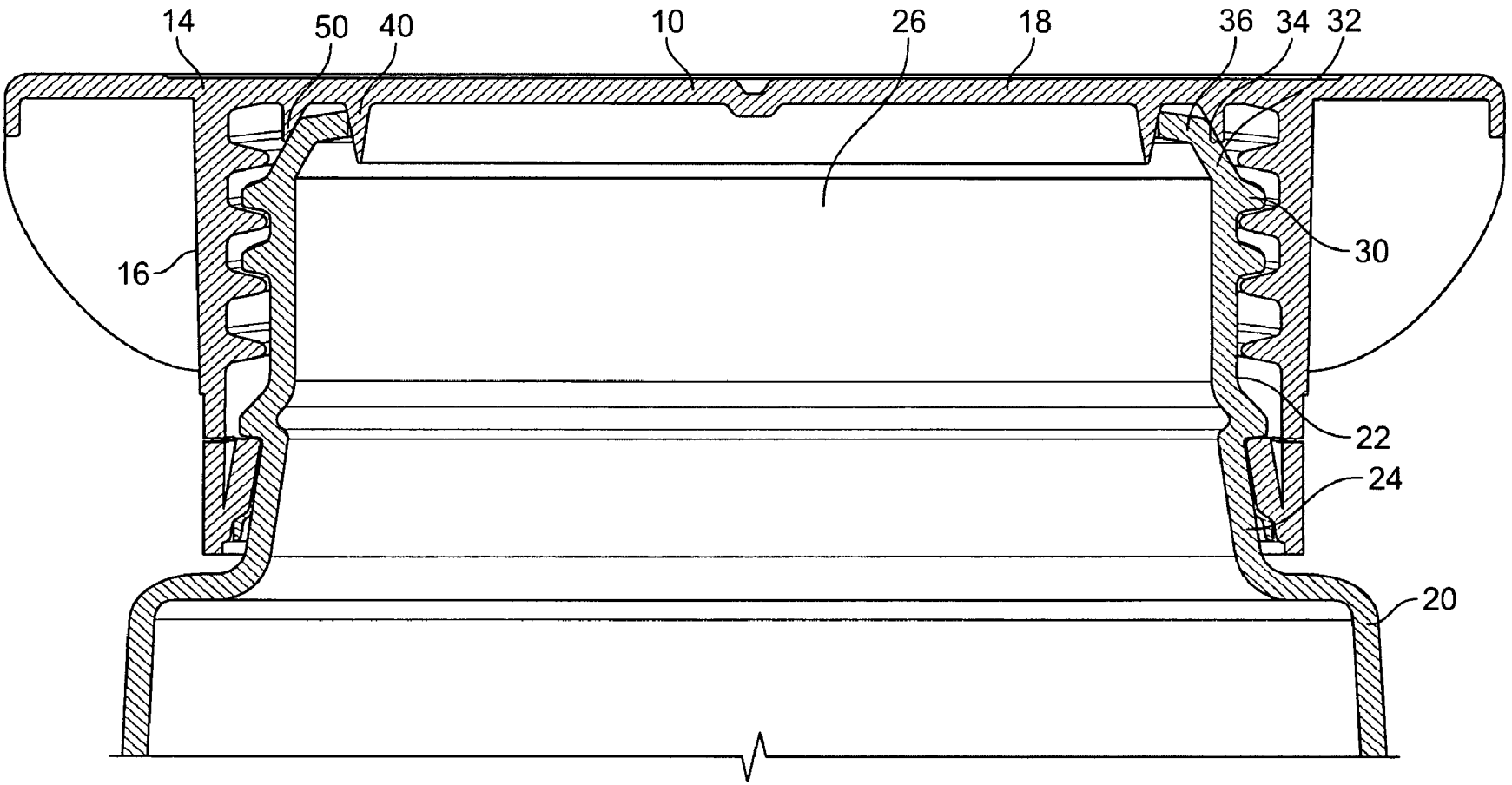
FIG. 1 is a cross-sectional view of one embodiment of the invention.
Figure 2:
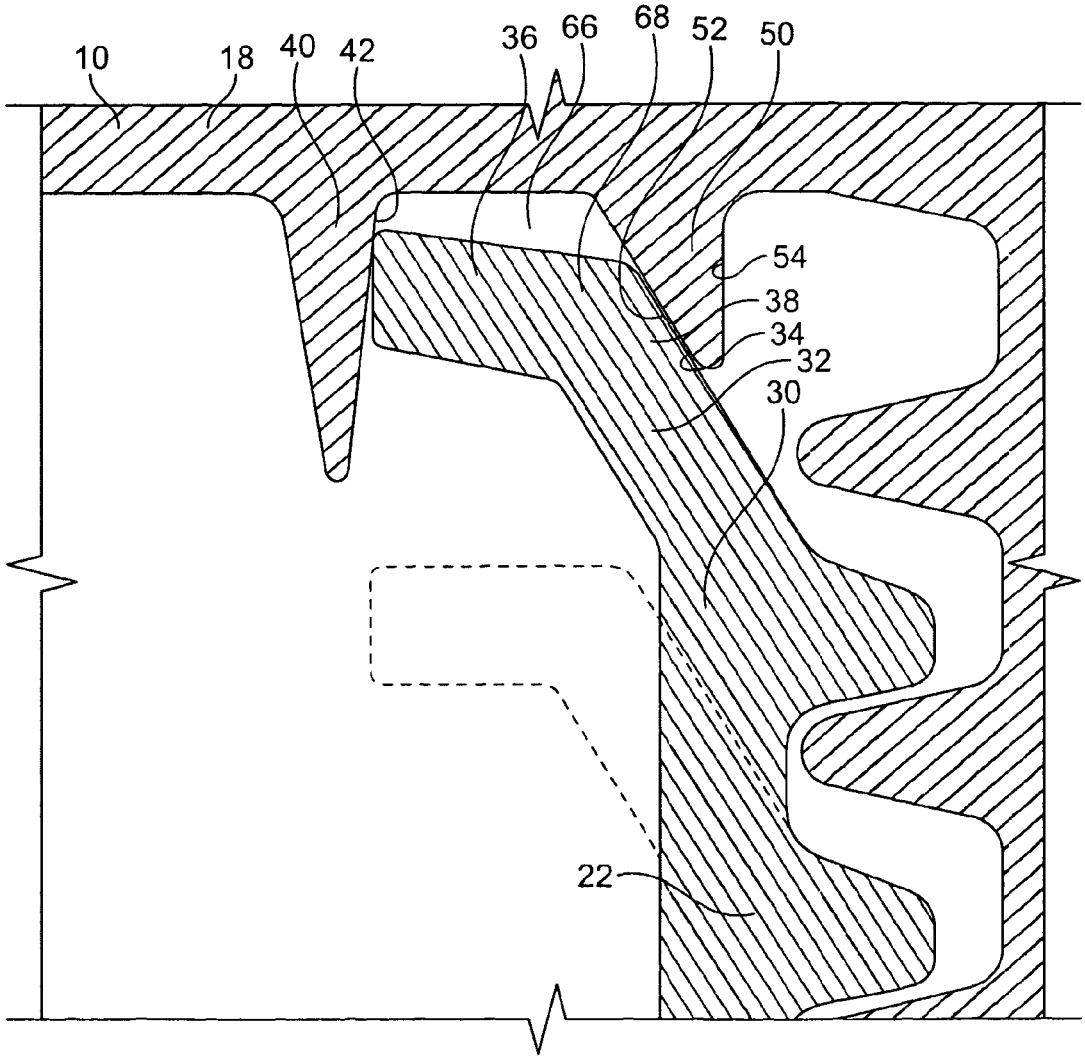
FIG. 2 is a blown-up cross-sectional view of one embodiment of the invention.
Figure 3:
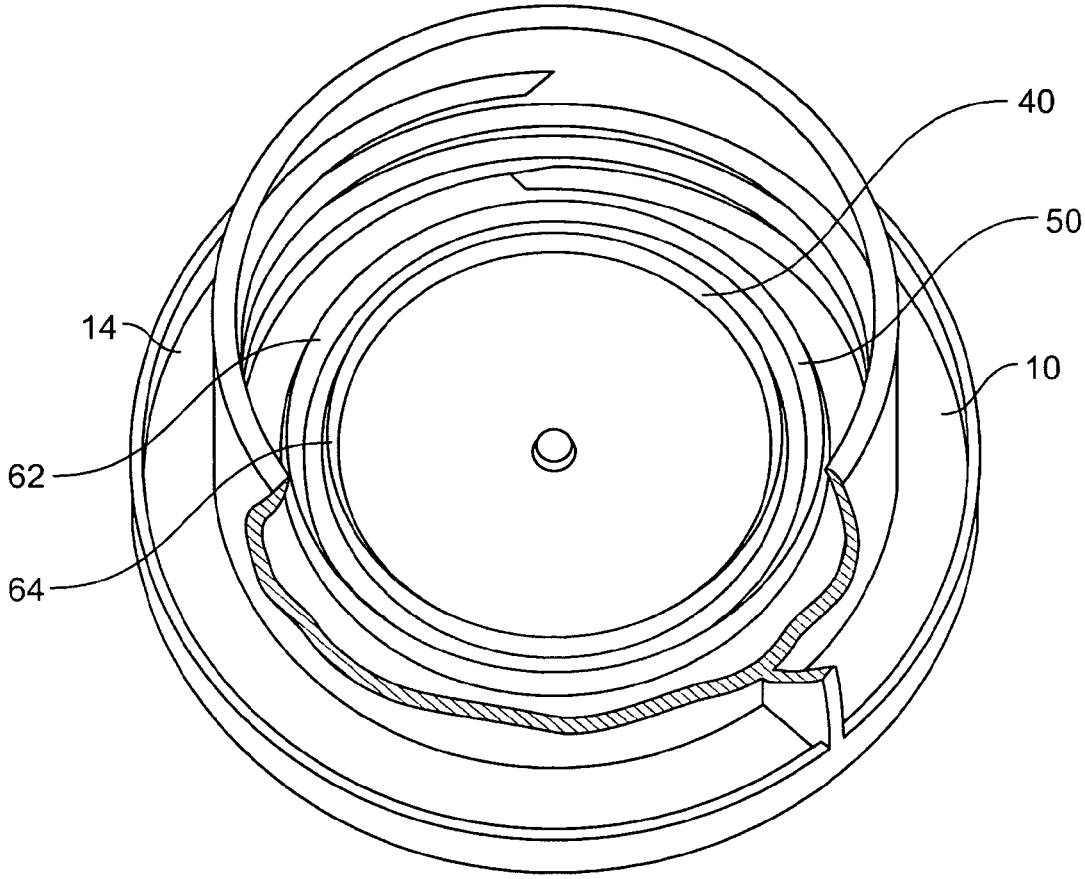
FIG. 3 is a perspective side view of one embodiment of the invention.

As seen in FIGS. 1-3, an embodiment of a container 20 and closure 10 combination is disclosed. The closure 10 can be configured to either snap or be threaded onto the container 20. The container 20 preferably has a neck 22 with a base portion 24 and an upper portion 30. The neck 22 defines the opening 26 of the container 20. The upper portion 30 has a proximal segment 32 that is oriented in a first inward angle relative to the base portion 24 and a distal segment 36 that is oriented in a second inward angle relative the base portion 24. The proximal segment 32 has an upper surface 34. Preferably, the proximal segment 32 is oriented at an angle that is about 5 to 60 degrees from the base portion 24 of the neck 22. The distal segment 36 can be oriented at an angle that is about 0.0 to 45 degrees off horizontal and preferably about 5 to 10 degrees from the base portion 24 of the neck 22. Preferably, when compared to the base portion 24 of the neck 22, which is preferably substantially vertical, the proximal segment 32 is oriented in a steeper slope while the distal segment 36 is oriented in a gentler slope. For example, in one embodiment, the proximal segment 32 defines a slope that is about 35 degrees steeper than the slope of the distal segment 36.

The closure 10 preferably has a generally planar top portion 18, an outer peripheral edge portion 14, and an annular skirt 16 depending from the peripheral edge portion 14. Preferably, the top portion 18 is circular and has at least one inner flange 40 and at least one outer flange 50 depending therefrom. Preferably, the outer flange 50 forms a first circular ring 62 which has a first diameter. The outer flange 50 is one continuous formation forming the first ring 62. The outer flange 50 is relatively flexible when compared to the inner flange 40. The outer flange 50 can have an angled inner surface 52 and an outer surface 54. The angled inner surface 52 is preferably at an angle off a vertical line about 5 to 80 degrees from the top portion. More preferably, the angled inner surface 52 is at an angle about 10 to 70 degrees from the top portion 18. Most preferably, the angled inner surface 52 is at an angle of about 30 degrees off vertical from the top portion 18. Preferably, the outer surface 54 is oriented substantially perpendicular to the top portion 18. The outer flange 50 can have a cross-sectional shape of a right triangle with the inner angled surface being the hypotenuse.

The inner flange 40 should be relatively rigid compared to the outer flange 50 and have an outer angled surface 42. It should have a triangular cross-sectional shape.

As shown in FIG. 3, preferably, the inner flange 40 forms a second circular ring 64 which has a second diameter that is less than the first diameter. The inner flange 40 can be one continuous formation forming the second ring 64, or it can be a plurality of segments that, together, effectively forms the second ring 64. The outer angled surface 42 of the inner flange 40 is preferably at an angle of about 60 to 85 degrees from the top portion 18. More preferably, the outer angled surface 42 is at an angle of about 82 degrees from the top portion 18. The inner flange 40 can have a cross-sectional shape of an isosceles triangle.

The inner flange 40 and outer flange 50 each have a height which is the distance that they depend from the top portion 18. In one embodiment, the inner flange 40 and outer flange 50 have the same height. In another embodiment, the inner flange 40 has a greater height than the outer flange 50. In another embodiment, the inner flange 40 has a lesser height than the outer flange 50.

In one embodiment, the inner flange 40 and outer flange 50 can be oriented in concentric rings 62, 64 on the top portion 18. The inner flange 40 and outer flange 50 define a channel 66 between them. Preferably, the channel 66 is capable of receiving a part 68 of the upper portion 30 of the neck 22. Preferably, the part 68 of the upper portion 30 of the neck 22 includes the distal segment 36 and a portion of the proximal segment 32. Preferably, the upper portion 30 of the neck 22 is flexible. When received, the inner flange 40 biases the part 68 of the upper portion 30 of neck 22 that is in the channel 66 against the outer flange 50. The inner flange 40 can act like a backstop that causes the upper portion 30 of the neck 22 to become wedged in the channel 66. Preferably, the surface 34 of part 68 of the upper portion 30 of the neck 22 is biased against the inner surface 52 of the outer flange 50. Preferably, the part 68 of the upper portion 30 forms a surface seal between the surface 34 of part 68 and the inner surface 52. More preferably, at least part of an upper surface 34 of the proximal segment 32 of the neck 22 and at least part of the inner surface 52 of the outer flange 50 form a surface seal. Generally, the upper portion 30 of the neck will not form a seal with the inner flange 40. As used herein, the term surface seal is a joining along a surface of a first object and a surface of a second object for a distance along both surfaces. As such, the surface seal defines an area. This would be in comparison to a line seal, which would be a joining of an edge of one object and the surface of a second object. In addition, under certain conditions, upper surface 34 may contact the inner surface 42 or the top portion 18 of the closure 10 to form a secondary seal.

To effectuate the surface seal, it is preferred that the slope of the distal segment 36 of the neck 22 and the slope of the inner surface 52 of the outer flange 50 are relatively similar. For example, in one embodiment, the proximal segment 32 has a slope that is about 0 to 6.0 degrees offset from the inner surface 52 of the outer flange 50. Preferably, the proximal segment 32 has a slope that is about 1.0 to 3.0 degrees offset from the inner surface 52. When biased, the upper surface 38 of the proximal segment 32 and the inner surface 52 of the outer flange 50 are abutted or pushed together to form a surface seal.

As shown in FIG. 2, as the container 20 and closure 10 are mated, the neck 22 of the container 20 and the top portion 18 of the container 20 move closer together. The angled nature of the outer flange 50 and the slope of the upper portion 30 of the neck 22 guide the combination into the proper closed position.

Figure 4:
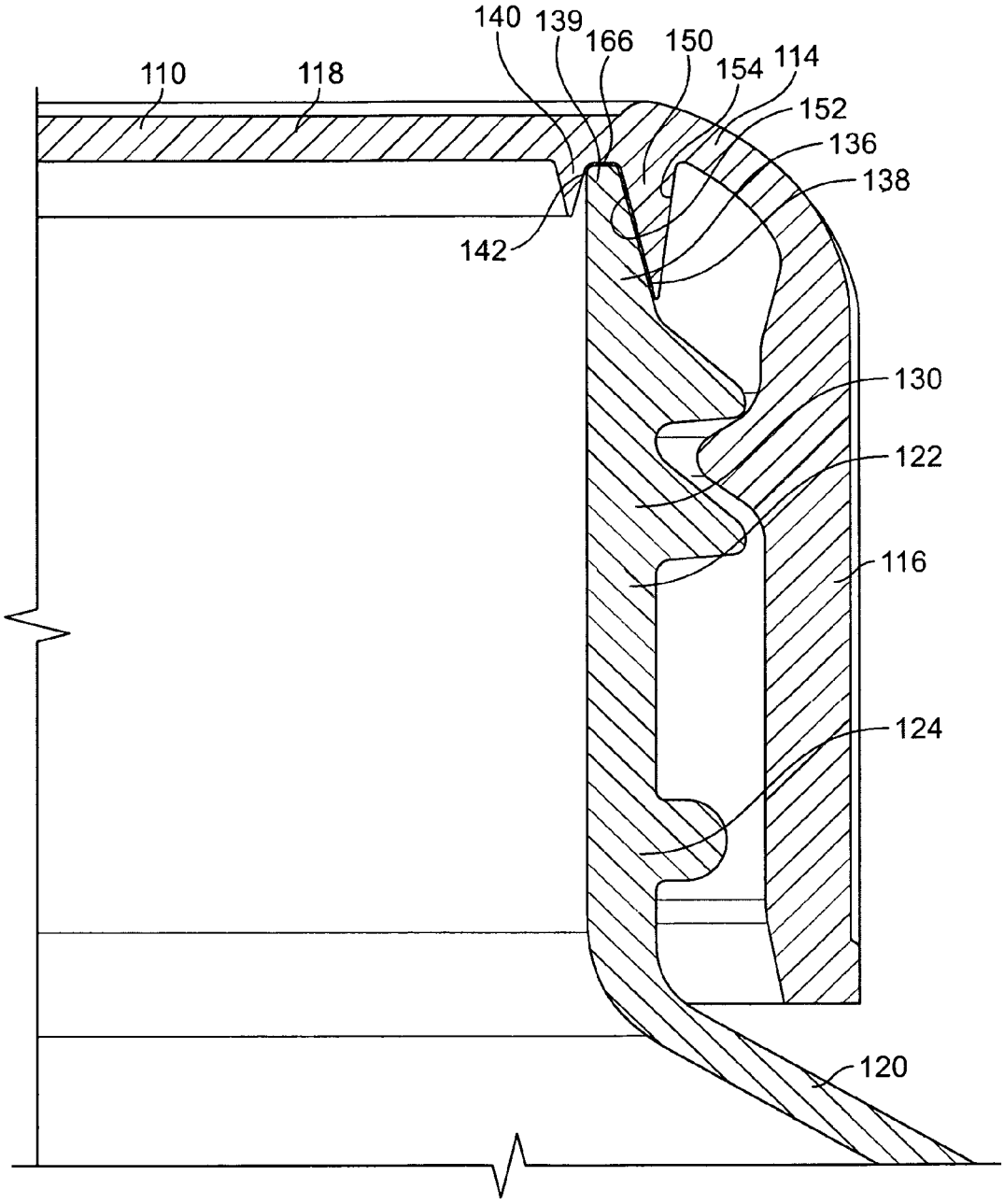
FIG. 4 is a cross-sectional view of one embodiment of the invention.

FIG. 4 shows an embodiment of a closure 110 and container 120 combination. The container 120 preferably has a neck 122 with a base portion 124 and an upper portion 130. The neck 122 defines an opening 126 of the container 120. The upper portion 130 has a distal segment 136 that has an outer wall 138 and an inner wall 139. Preferably, the outer wall 138 is angled at about 5 to 60 degrees off vertical from the neck 122. More preferably, the outer wall 138 is angled at about 30 degrees off vertical.

The closure 110 preferably has a generally planar top portion 118, an outer peripheral edge portion 114, and an annular skirt 116 depending from the peripheral edge portion 114. Preferably, the top portion 118 is circular and has at least one inner flange 140 and at least one outer flange 150 depending therefrom. The outer flange 150 is relatively flexible when compared to the inner flange 140. The outer flange 150 can have an angled inner surface 152 and an outer surface 154. The angled inner surface 152 is preferably at an angle about 5 to 80 degrees off vertical from the top portion 118. More preferably, the angled inner surface 152 is at an angle about 10 to 70 degrees from the top portion 118. Most preferably, the angled inner surface 152 is at an angle of about 30 degrees off vertical from the top portion 118. Preferably, the outer surface 154 is oriented substantially perpendicular to the top portion 118. The outer flange 150 can have a cross-sectional shape of a right triangle with the inner angled surface being the hypotenuse.

The inner flange 140 can be relatively rigid compared to the outer flange 150 and have an outer angled surface 142. The inner flange 140 can have a triangular cross-sectional shape. The outer angled surface 142 of the inner flange 40 is preferably at an angle of about 40 to 85 degrees from the top portion 118. More preferably, the outer angled surface 142 is at an angle of about 60 degrees from the top portion 118. The inner flange 140 can have a cross-sectional shape of an isosceles triangle.

The inner flange 140 and outer flange 150 each have a height which is the distance that they depend from the top portion 118. In one embodiment, the inner flange 140 and outer flange 150 have the same height. In another embodiment, the inner flange 140 has a greater height than the outer flange 150. In another embodiment, the inner flange 140 has a lesser height than the outer flange 150.

The inner flange 140 and outer flange 150 define a channel 166 between them. Preferably, the channel 166 is capable of receiving a part of the distal segment 136 of the neck 122. The distal segment 136 can be composed of PET and be relatively inflexible. When received, the inner flange 140 biases the distal segment 136 that is in the channel 166 against the outer flange 150. The inner flange 140 can act like a backstop that causes part of the distal segment 136 of the 122 to become wedged in the channel 166. Preferably, the distal segment 136 is biased against the inner surface 152 of the outer flange 150. Preferably, the outer wall 138 of the distal segment 136 forms a surface seal with the inner surface 152 of the outer flange 150. To allow for the surface seal, it is preferred that the inner surface 152 has a slope that is about 0 to 6.0 degrees offset from the slope of the outer wall 138. More preferably, the inner surface 152 has a slope that is about 1.0 to 3.0 degrees offset from the slope of the outer wall 138. The inner wall 139 of the distal segment 136 of the neck 122 may form a surface seal with the inner flange 140.

The closure 10 can be comprised of a variety of different materials that are known in the art. The closure 10 can be comprised of plastic including the specific plastic PET. The container 20 can be comprised of a variety of different materials, including plastic.

The invention claimed is:

1. A molded closure and container combination comprising:

a plastic container having a neck with a base portion and a flexible upper portion, the upper portion having a proximal segment sealing surface oriented at a first angle relative to the base portion and an adjacent distal segment oriented at a second angle relative to the base portion;

a plastic closure having a generally planar top portion with an inner face, an outer peripheral edge and an annular skirt, the inner face having a rigid inner flange with an outer angled surface of about 60-85° from vertical and an outer flange in the cross-sectional shape of a right triangle with an outer surface substantially perpendicular to the planar top portion, and an angled inner surface that, at rest, has an angle similar to the first angle of the proximal segment sealing surface of the neck, the inner flange having a height larger than or equal to the angled outer surface;

wherein the angled inner surface of the outer flange and the outer angled surface of the inner flange define a channel that can receive a part of the upper portion of the neck, wherein the inner flange is capable of biasing the part of the upper portion of the neck against the outer flange such that the inner surface of the outer flange forms a surface seal with the part of the upper portion of the neck.

2. The closure and container combination of claim 1, wherein the inner flange and outer flange extend circularly around the inner face of the closure.

3. The closure and container combination of claim 1, wherein the angled inner surface of the outer flange is 1.0 to 3.0 degrees offset from the proximal segment sealing surface of the neck.

4. The closure and container combination of claim 1, wherein the part of the upper portion of the neck comprises the distal segment and a portion of the proximal segment.

5. The closure and container combination of claim 1, wherein the part of the upper portion of the neck that forms the surface seal with the inner surface of the outer flange is the upper surface of the proximal segment sealing surface.

6. The closure and container combination of claim 1, wherein the angled inner surface of the outer flange forms about a 10-70 degree angle from the top portion.

7. The closure and container combination of claim 1, wherein the angled inner surface of the outer flange forms about a 30 degree angle from the top portion.

8. The closure and container combination of claim 1, wherein the inner flange has a cross-sectional shape of an isosceles triangle.

9. The closure and container combination of claim 1, wherein the inner flange and outer flange have the same height.

10. The closure and container combination of claim 1, wherein the inner flange has a greater height than the outer flange.

11. A molded closure and container combination comprising:

a container having a neck with a base portion and an upper portion, the upper portion having a first distal inwardly angled surface at a second angle and a second adjacent segment oriented at a first angle relative to said base portion, said first angle different from said second angle and inwardly directed;

a closure having a generally planar top portion with a bottom surface, an outer peripheral edge and an annular skirt, the bottom surface having a rigid inner flange with an outer angled surface of about 60 to about 85° from vertical, and an outer flange depending therefrom, the outer flange having an angled inner surface that, at rest, has an angle similar to the first angle of the second adjacent segment of the upper portion of the container and an outer surface substantially perpendicular to the planar top portion, an inner flange with an outer angled surface, the angled inner surface of the outer flange and the outer angled surface of the inner flange defining a channel, wherein in a closed position a part of the upper portion of the neck is wedged into the channel such that a surface seal is formed between at least part of the inner surface of the outer flange and at least part of the second adjacent segment of the upper portion of the neck, and a second seal is formed between an end of said first distal inwardly angled surface and the outer angled surface of the inner flange.

12. The molded closure and container combination of claim 11, wherein the angled inner surface is about 1.5 to 3.0 degrees offset from the distal inwardly angled surface.

13. The molded closure and container combination of claim 11, wherein the part of the upper portion is biased against the outer flange.

* * * * *